US012220785B2

(12) United States Patent
Nakano et al.

(10) Patent No.: US 12,220,785 B2
(45) Date of Patent: Feb. 11, 2025

(54) CHUCK TABLE AND GRINDING METHOD OF WORKPIECES

(71) Applicant: DISCO CORPORATION, Tokyo (JP)

(72) Inventors: Keisuke Nakano, Tokyo (JP); Ryo Shimazu, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 360 days.

(21) Appl. No.: 17/805,541

(22) Filed: Jun. 6, 2022

(65) Prior Publication Data

US 2022/0395959 A1 Dec. 15, 2022

(30) Foreign Application Priority Data

Jun. 15, 2021 (JP) ..... 2021-099331

(51) Int. Cl.
*B24B 41/06* (2012.01)
*B24B 7/07* (2006.01)

(52) U.S. Cl.
CPC ..... *B24B 41/06* (2013.01); *B24B 7/07* (2013.01)

(58) Field of Classification Search
CPC ..... B24B 41/06; B24B 41/04; B24B 41/00; B24B 41/005; B24B 41/02; B24B 41/068; B24B 7/07; B24B 7/228; B24B 19/22; B24B 47/22; B24B 37/00; B24B 37/005; B24B 37/04; B24B 37/042; B24B 37/07; B24B 37/10; B24B 37/105; B24B 37/30; B24B 37/34; B24B 37/345; B24B 27/0076; H01L 21/67092; H01L 21/02013; B23Q 1/012; B23Q 1/017; B23Q 1/037; B23Q 1/64; B23Q 1/035; B23Q 1/25; B25B 11/005
USPC ..... 451/28; 269/58, 71, 55, 60
See application file for complete search history.

(56) References Cited

U.S. PATENT DOCUMENTS

2017/0095902 A1* 4/2017 Yoshida ..... B24B 7/228
2019/0291239 A1* 9/2019 Yoshida ..... B24B 27/0023
2021/0023674 A1* 1/2021 Genozono ..... B24B 37/013

FOREIGN PATENT DOCUMENTS

JP 2005028550 A 2/2005
JP 2014075408 A 4/2014
JP 2017147304 A * 8/2017
JP 2019149461 A 9/2019
JP 2020089930 A * 6/2020 ..... B24B 1/00

* cited by examiner

*Primary Examiner* — David S Posigian
*Assistant Examiner* — Michael A Gump
(74) *Attorney, Agent, or Firm* — Greer Burns & Crain Ltd.

(57) ABSTRACT

Multiple holding surfaces of a chuck table are disposed in such a manner that the heights thereof from a reference surface are in increasing order along a first direction parallel to each of them. Thus, in a case of using this chuck table, creep-feed grinding for workpieces each held by a respective one of the multiple holding surfaces can be executed in states in which a grinding unit is positioned at different heights. In this case, the workpiece for which the creep-feed grinding has been executed is located on the lower side as viewed from the grinding unit when another workpiece is ground. Due to this, in this creep-feed grinding, a specific workpiece can be prevented from being ground twice.

9 Claims, 9 Drawing Sheets

CHUCK TABLE AND GRINDING METHOD OF WORKPIECES

BACKGROUND OF THE INVENTION

Field of the Invention

The present invention relates to a chuck table that holds each of workpieces by a respective one of multiple holding surfaces, a grinding apparatus including this chuck table, and a grinding method for workpieces in which the workpieces are ground by using this grinding apparatus.

Description of the Related Art

Chips of devices such as an integrated circuit (IC) and a large scale integration (LSI) circuit are constituent elements that are indispensable in various kinds of electronic equipment such as mobile phones and personal computers. Such chips are manufactured by dividing a wafer on which a large number of devices are formed on a front surface into each region including the individual device, for example.

Moreover, this wafer is thinned before the dividing thereof in many cases for the purposes of size reduction and weight reduction of the chips, and so forth. Grinding by a grinding apparatus is cited as a method for thinning the wafer. For example, this grinding apparatus includes a chuck table having a holding surface that holds the wafer and a grinding unit that is disposed over the chuck table and has a spindle having a lower end part to and from which a grinding wheel in which multiple grinding abrasive stones are annularly disposed in a discrete manner can be attached and detached.

In such a grinding apparatus, a wafer is often thinned by a grinding method referred to also as creep-feed grinding (for example, refer to Japanese Patent Laid-open No. 2005-28550). In this grinding method, first, the holding surface of the chuck table is caused to hold the side of the front surface of the wafer. Subsequently, the lower surface of each of the multiple grinding abrasive stones is positioned to a height between the back surface (upper surface) and the front surface (lower surface) of the wafer in a state in which the grinding unit is positioned on the rear side as viewed from the chuck table.

Then, while the chuck table and the grinding unit are relatively moved along the front-rear direction, multiple grinding abrasive stones located on the front side of the rotating grinding wheel are brought into contact with the side of the upper surface (back surface) of the wafer held by the chuck table from the rear side thereof. As a result, the side of the upper surface (back surface) of the wafer is ground from the rear end to the front end by the multiple grinding abrasive stones. As a result, the wafer is thinned to have a predetermined finished thickness.

SUMMARY OF THE INVENTION

The grinding apparatus is used in not only thinning of a wafer with a circular disc shape but also thinning of a workpiece such as a package substrate with a rectangular parallelepiped shape, such as a chip size package (CSP) substrate or quad flat non-leaded package (QFN) substrate. In general, the grinding apparatus used for grinding of such a workpiece includes the chuck table over which multiple holding surfaces that each have the same shape (for example, a rectangular shape) and are parallel to each other are disposed to line up in the front-rear direction.

Further, when creep-feed grinding is executed in a state in which workpieces are each held by a respective one of these multiple holding surfaces, grinding is sequentially executed from the workpiece located at the rear end in the multiple workpieces. As a result, each of the multiple workpieces is thinned to have a predetermined finished thickness.

However, in a case of thinning multiple workpieces as above, only the workpiece located at the rear end in the multiple workpieces is ground twice in some cases. Specifically, this workpiece is first ground by multiple grinding abrasive stones located on the front side in the rotating grinding wheel and thereafter is ground again by multiple grinding abrasive stones located on the rear side in the rotating grinding wheel in some cases.

In this case, there is a possibility that variation is caused in the thickness of the multiple workpieces after the grinding. Further, there is also a possibility that an unintentional saw mark is formed in the upper surface of the workpiece located at the rear end in the multiple workpieces and a scratch or crack occurs in this workpiece.

In view of this point, an object of the present invention is to prevent a specific workpiece from being ground twice when creep-feed grinding is executed in a state in which workpieces are each held by a respective one of multiple holding surfaces of a chuck table.

In accordance with an aspect of the present invention, there is provided a chuck table including a first holding surface and a second holding surface that each have the same shape and are parallel to each other and a reference surface that surrounds each of the first holding surface and the second holding surface in plan view and is parallel to the first holding surface and the second holding surface. The chuck table holds each of workpieces by a respective one of the first holding surface and the second holding surface. The first holding surface and the second holding surface are disposed in such a manner that heights from the reference surface are in increasing order along a first direction parallel to each of the first holding surface and the second holding surface.

In accordance with another aspect of the present invention, there is provided a grinding apparatus including the above-described chuck table, a grinding unit having a spindle with a tip part on which a grinding wheel in which multiple grinding abrasive stones are annularly disposed is mounted, a first movement mechanism that relatively moves the chuck table and the grinding unit along a first direction, and a second movement mechanism that relatively moves the chuck table and the grinding unit along a second direction perpendicular to each of the reference surface, the first holding surface, and the second holding surface.

In accordance with a further aspect of the present invention, there is provided a grinding method for workpieces in which the workpieces are ground by using the above-described grinding apparatus. The grinding method for workpieces includes a holding step of causing each of the workpieces to be held by the respective one of the first holding surface and the second holding surface and a grinding step of, after the holding step, grinding the workpieces by relatively moving the chuck table and the grinding unit along the first direction and bringing the multiple grinding abrasive stones that rotate into contact with the workpieces each held by the respective one of the first holding surface and the second holding surface while widening the interval between the reference surface and the multiple grinding abrasive stones along the second direction in a stepwise manner to cause the workpieces each held by the respective one of the first holding surface and the second holding surface to have a predetermined finished thickness.

In accordance with a still further aspect of the present invention, there is provided a grinding method for workpieces in which the workpieces are ground by using a grinding apparatus including a chuck table including a first holding surface and a second holding surface that each have the same shape and are parallel to each other and a reference surface that surrounds each of the first holding surface and the second holding surface in plan view and is parallel to the first holding surface and the second holding surface. The chuck table holds each of the workpieces by a respective one of the first holding surface and the second holding surface. The grinding apparatus also includes a grinding unit having a spindle with a tip part on which a grinding wheel for the chuck table in which multiple grinding abrasive stones for the chuck table are annularly disposed or a grinding wheel for the workpiece in which multiple grinding abrasive stones for the workpiece are annularly disposed is mounted. The grinding apparatus includes also a first movement mechanism that relatively moves the chuck table and the grinding unit along a first direction parallel to each of the reference surface, the first holding surface, and the second holding surface and a second movement mechanism that relatively moves the chuck table and the grinding unit along a second direction perpendicular to each of the reference surface, the first holding surface, and the second holding surface. The grinding method for workpieces includes a holding surface grinding step of grinding the chuck table by relatively moving the chuck table and the grinding unit in which the grinding wheel for the chuck table is mounted on the tip part of the spindle along the first direction and bringing the multiple grinding abrasive stones for the chuck table that rotate into contact with the chuck table while widening the interval between the reference surface and the multiple grinding abrasive stones for the chuck table along the second direction in a stepwise manner to cause the heights of the first holding surface and the second holding surface from the reference surface to be in increasing order along the first direction. The grinding method for workpieces includes also a holding step of causing each of the workpieces to be held by the respective one of the first holding surface and the second holding surface after the holding surface grinding step and a grinding step of, after the holding step, grinding the workpieces by relatively moving the chuck table and the grinding unit in which the grinding wheel for the workpiece is mounted on the tip part of the spindle along the first direction and bringing the multiple grinding abrasive stones for the workpiece that rotate into contact with the workpieces each held by the respective one of the first holding surface and the second holding surface while widening the interval between the reference surface and the multiple grinding abrasive stones for the workpiece along the second direction in a stepwise manner to cause the workpieces each held by the respective one of the first holding surface and the second holding surface to have a predetermined finished thickness.

In the chuck table of the present invention, the first holding surface and the second holding surface are disposed in such a manner that the heights thereof from the reference surface are in increasing order along the first direction parallel to each of them. Thus, in a case of using this chuck table, creep-feed grinding for the workpieces each held by the respective one of the first holding surface and the second holding surface can be executed in states in which the grinding unit is positioned at different heights.

In this case, the workpiece for which the creep-feed grinding has been executed is located on the lower side as viewed from the grinding unit when another workpiece is ground. Due to this, in this creep-feed grinding, the specific workpiece can be prevented from being ground twice.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1A:
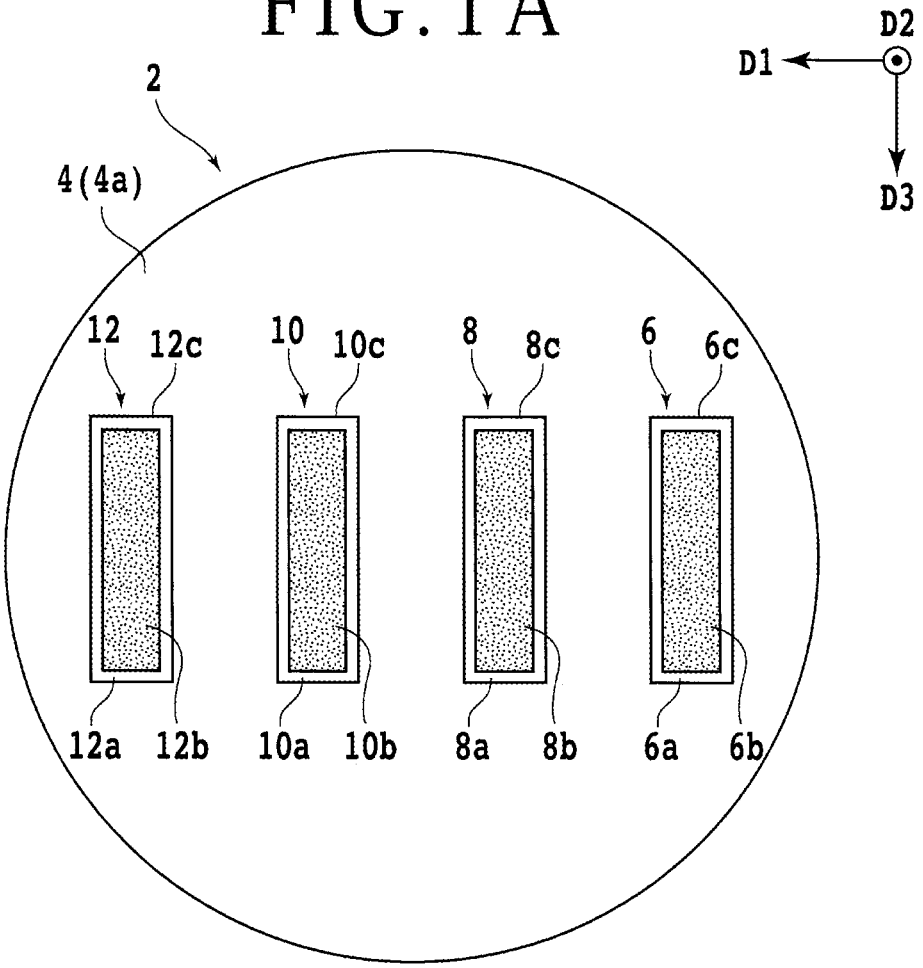
FIG. 1A is a top view schematically illustrating one example of a chuck table.
Figure 1B:
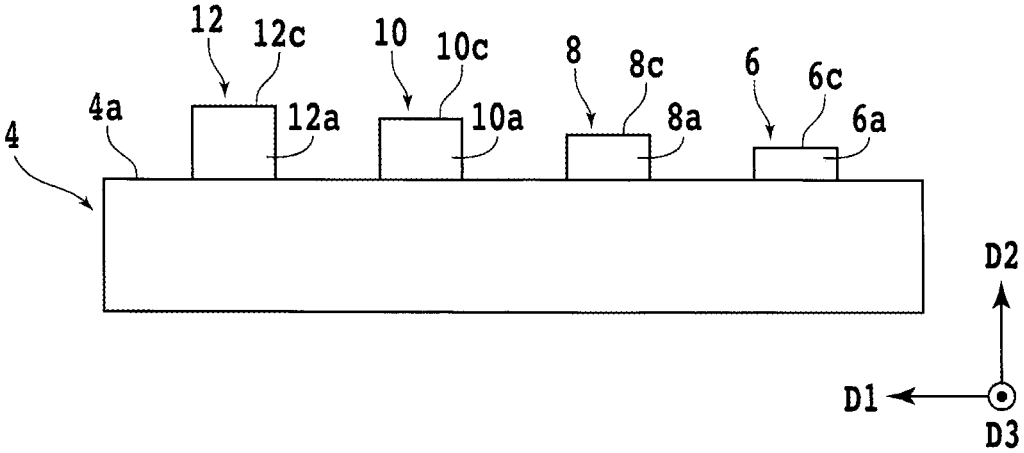
FIG. 1B is a side view schematically illustrating the one example of the chuck table.

An embodiment of the present invention will be described with reference to the accompanying drawings. FIG. 1A is a top view schematically illustrating one example of a chuck table. FIG. 1B is a side view schematically illustrating the one example of the chuck table. A chuck table 2 illustrated in FIG. 1A and FIG. 1B has a base part 4 that is composed of ceramic or the like and has a circular disc shape, for example.

This base part 4 has a flat upper surface (reference surface) 4*a*. Further, on this reference surface 4*a*, multiple (for example, four) holding parts 6, 8, 10, and 12 with a rectangular parallelepiped shape are disposed to line up along a first direction (D1) parallel to the reference surface 4*a* and protrude along a second direction (D2) perpendicular to the reference surface 4*a*.

The multiple holding parts 6, 8, 10, and 12 have frame bodies 6*a*, 8*a*, 10*a*, and 12*a*, respectively, that are composed of ceramic or the like and have a rectangular parallelepiped shape, and a recessed part is formed at the upper part of each of the frame bodies 6*a*, 8*a*, 10*a*, and 12*a*. To these recessed parts, porous plates 6*b*, 8*b*, 10*b*, and 12*b* that are composed of ceramic or the like and have a rectangular parallelepiped shape are fixed.

Moreover, the porous plates 6*b*, 8*b*, 10*b*, and 12*b* have upper surfaces parallel to the reference surface 4*a*. In addition, a suction path for allowing the side of the lower surface of the porous plates 6*b*, 8*b*, 10*b*, and 12*b* to communicate with a suction source such as an ejector is made inside each of the base part 4 and the multiple holding parts 6, 8, 10, and 12.

Further, a negative pressure is generated in spaces near the upper surfaces of the porous plates 6*b*, 8*b*, 10*b*, and 12*b* when the suction source operates in a state in which this suction path communicates with the suction source. Thus, in each of the multiple holding parts 6, 8, 10, and 12, upper surfaces 6*c*, 8*c*, 10*c*, and 12*c* thereof function as holding surfaces that hold a workpiece.

The reference surface 4*a* of the base part 4 is disposed to surround the upper surfaces (holding surfaces) 6*c*, 8*c*, 10*c*, and 12*c* of the holding parts 6, 8, 10, and 12 in plan view. Further, each of the multiple holding surfaces 6*c*, 8*c*, 10*c*, and 12*c* is parallel to the reference surface 4*a*.

Moreover, the multiple holding surfaces 6*c*, 8*c*, 10*c*, and 12*c* have the same shape. Specifically, the shape of each of the multiple holding surfaces 6*c*, 8*c*, 10*c*, and 12*c* is a rectangular shape having a pair of short sides that extend along the first direction and a pair of long sides that extend along a third direction (D3) perpendicular to the first direction and the second direction.

However, the heights of the multiple holding surfaces 6*c*, 8*c*, 10*c*, and 12*c* from the reference surface 4*a* are different. Specifically, the heights of the multiple holding surfaces 6*c*, 8*c*, 10*c*, and 12*c* from the reference surface 4*a* are in increasing order along the first direction. That is, the holding surface 6*c* is lower than the other holding surfaces 8*c*, 10*c*, and 12*c*. Further, the holding surface 8*c* is lower than the holding surfaces 10*c* and 12*c*. In addition, the holding surface 10*c* is lower than the holding surface 12*c*.

Moreover, the difference in the height between the pair of holding surfaces adjacent along the first direction (for example, the holding surface 6*c* and holding surface 8*c*) is decided in consideration of variation in the thickness of the workpiece held in each of the multiple holding surfaces 6*c*, 8*c*, 10*c*, and 12*c*. Specifically, this difference is at least 10 μm and at most 300 μm (for example, 50 μm).

Figure 2:
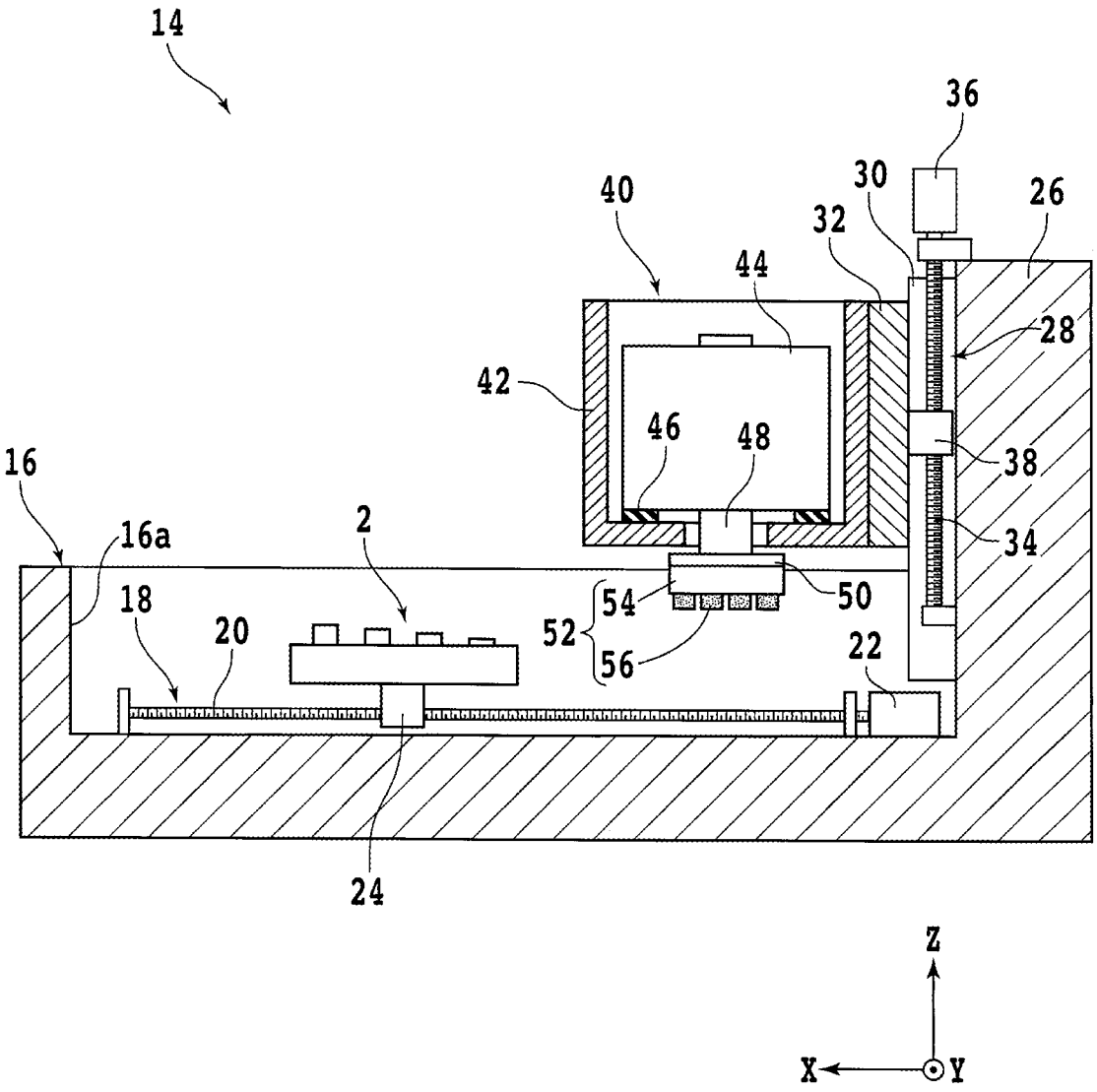
FIG. 2 is a partially sectional side view schematically illustrating one example of a grinding apparatus including the chuck table illustrated in FIG. 1A and FIG. 1B.

FIG. 2 is a partially sectional side view schematically illustrating one example of a grinding apparatus including the chuck table 2. An X-axis direction (front-rear direction) and a Y-axis direction (left-right direction) illustrated in FIG. 2 are directions perpendicular to each other on the horizontal plane. Further, a Z-axis direction (upward-downward direction) is the direction (vertical direction) perpendicular to the X-axis direction and the Y-axis direction.

A grinding apparatus 14 illustrated in FIG. 2 includes a base 16 that supports or houses the respective constituent elements. An opening 16*a* with a rectangular parallelepiped shape is made on the side of the upper surface of the base 16. Further, an X-axis movement mechanism (first movement mechanism) 18 is disposed inside the opening 16*a*. This X-axis movement mechanism 18 has a screw shaft 20 that extends along the X-axis direction.

A motor 22 for rotating the screw shaft 20 is coupled to one end part of the screw shaft 20. Further, a nut part 24 that houses balls that roll on the surface of the screw shaft 20 that rotates is disposed on the surface of the screw shaft 20 in which a spiral groove is formed, so that a ball screw is configured.

That is, when the screw shaft 20 rotates, the balls circulate in the nut part 24, and the nut part 24 moves along the X-axis direction. Moreover, the lower part of the chuck table 2 is mounted on the upper part of this nut part 24 in such a manner that the above-described first direction (D1), second direction (D2), and third direction (D3) become parallel to the X-axis direction, the Z-axis direction, and the Y-axis direction, respectively. Thus, when the screw shaft 20 is rotated by the motor 22, the chuck table 2 moves along the X-axis direction together with the nut part 24.

Moreover, the grinding apparatus 14 incorporates a suction source (not illustrated), and this suction source communicates with the suction path made inside each of the base part 4 and the multiple holding parts 6, 8, 10, and 12 through a valve (not illustrated) and so forth. Thus, by opening the valve in a state in which this suction source is operated, workpieces can be held in the holding surfaces 6*c*, 8*c*, 10*c*, and 12*c* of the multiple holding parts 6, 8, 10, and 12.

A support structure 26 with a rectangular parallelepiped shape is disposed on the rear side (right side of FIG. 2) of the chuck table 2 and the X-axis movement mechanism 18. Further, a Z-axis movement mechanism (second movement mechanism) 28 is disposed on the side of the front surface (front face) of the support structure 26. The Z-axis movement mechanism 28 is coupled to a grinding unit 40 to be described later and moves the grinding unit 40 along the Z-axis direction.

The Z-axis movement mechanism 28 has a pair of guide rails 30 that are fixed to the side of the front surface of the support structure 26 and extend along the Z-axis direction. A moving plate 32 is coupled to the side of the front face of the pair of guide rails 30 slidably along the pair of guide rails 30.

A screw shaft 34 that extends along the Z-axis direction is disposed between the pair of guide rails 30. A motor 36 for rotating the screw shaft 34 is coupled to one end part of the screw shaft 34. Further, a nut part 38 that houses balls that roll on the surface of the screw shaft 34 that rotates is disposed on the surface of the screw shaft 34 in which a spiral groove is formed, so that a ball screw is configured.

That is, when the screw shaft 34 rotates, the balls circulate in the nut part 38, and the nut part 38 moves along the Z-axis direction. Moreover, the nut part 38 is fixed to the side of the back surface (rear face) of the moving plate 32. Thus, when the screw shaft 34 is rotated by the motor 36, the moving plate 32 moves along the Z-axis direction together with the nut part 38.

The grinding unit 40 is disposed on the side of the front surface (front face) of the moving plate 32. The grinding unit 40 has a support component 42 that is fixed to the side of the front surface of the moving plate 32 and has a hollow circular column shape. A housing 44 with a hollow circular column shape is housed in the support component 42. The housing 44 is fixed to the bottom wall of the support component 42 with the interposition of a connecting component 46 disposed on the lower surface of the housing 44.

In the housing 44, a circular columnar spindle 48 that extends along the Z-axis direction is rotatably housed. The tip (lower end) part of the spindle 48 is exposed from the housing 44 and passed through an opening made in the bottom wall of the support component 42 and protrudes downward from the bottom surface of the support component 42. Further, a mount 50 that is composed of metal or the like and has a circular disc shape is fixed to the tip part of the spindle 48.

The diameter of the mount 50 is shorter than the diameter of the chuck table 2 (diameter of the reference surface 4*a* of the base part 4). In FIG. 2, the mount 50 having a diameter that is approximately half the diameter of the chuck table 2 is illustrated. Moreover, an annular grinding wheel 52 is detachably mounted on the side of the lower surface of the mount 50.

For example, this grinding wheel 52 has a circular annular wheel base 54 composed of a metal such as aluminum or stainless steel, and the outer diameter of the wheel base 54 is substantially equal to the diameter of the mount 50. That is, in FIG. 2, the wheel base 54 having a diameter that is approximately half the diameter of the chuck table 2 is illustrated.

Further, the side of the upper surface of the wheel base 54 is fixed to the side of the lower surface of the mount 50 by a fixing component such as a bolt. Moreover, multiple grinding abrasive stones 56 annularly disposed in a discrete manner are fixed to the side of the lower surface of the wheel base 54. The multiple grinding abrasive stones 56 each have a rectangular parallelepiped shape, for example, and are disposed at substantially equal intervals along the circumferential direction of the wheel base 54.

The grinding abrasive stones 56 are formed by fixing abrasive grains composed of diamond, cubic boron nitride (cBN), or the like by a binding material (bond material) composed of a metal bond, resin bond, vitrified bond, or the like. However, there is no limitation on the material, shape, structure, size, and so forth of the grinding abrasive stones 56. Further, the number of multiple grinding abrasive stones 56 is optionally set.

Moreover, a rotational drive source (not illustrated) such as a motor for rotating the spindle 48 is coupled to the base end (upper end) part of the spindle 48. When this rotational drive source rotates the spindle 48 around a rotation axis along the Z-axis direction, the mount 50 and the grinding wheel 52 (wheel base 54 and multiple grinding abrasive stones 56) rotate together with the spindle 48.

Figure 3:
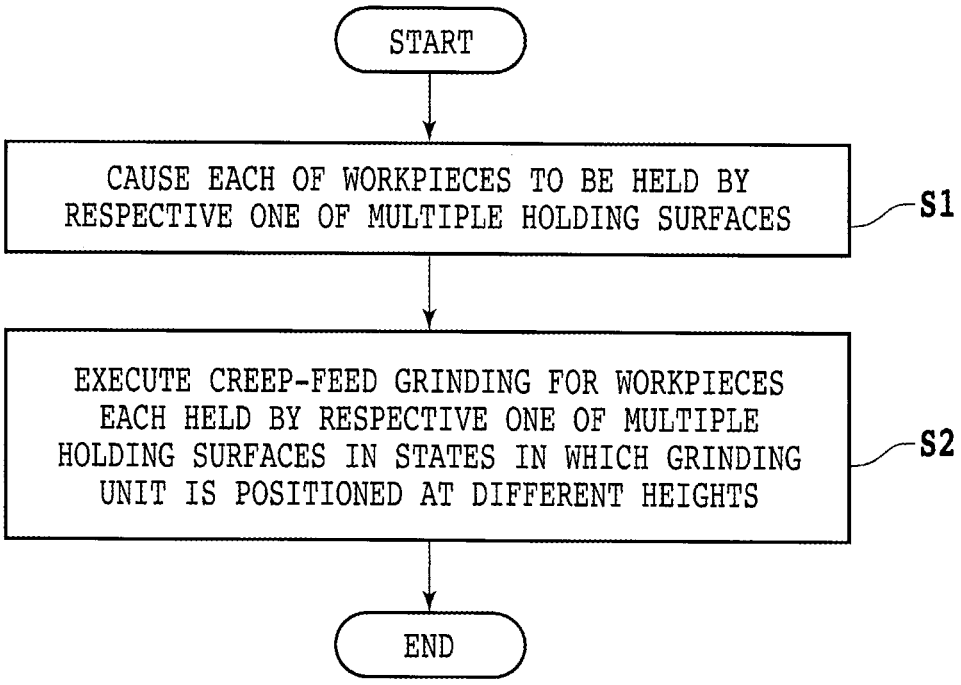
FIG. 3 is a flowchart schematically illustrating one example of a grinding method for workpieces in which the workpieces are ground by using the grinding apparatus illustrated in FIG. 2.
Figure 4A:
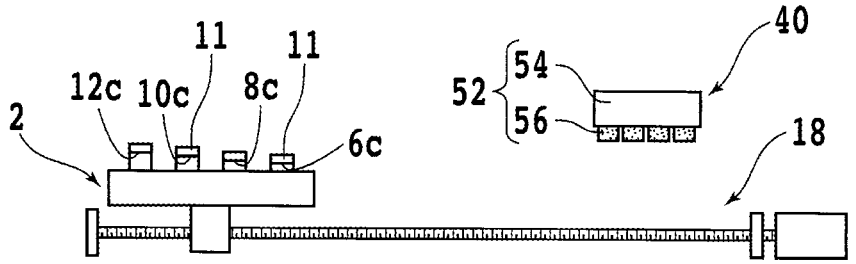
FIG. 4A is a side view schematically illustrating the state of a holding step.
Figure 4B:
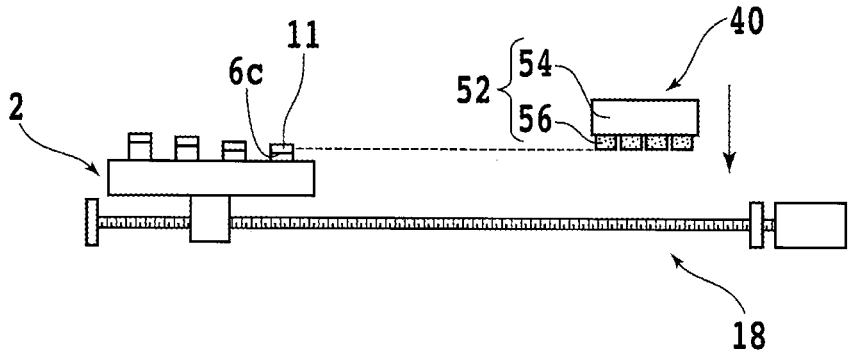
FIG. 4B is a side view schematically illustrating the state of a grinding step.
Figure 4C:
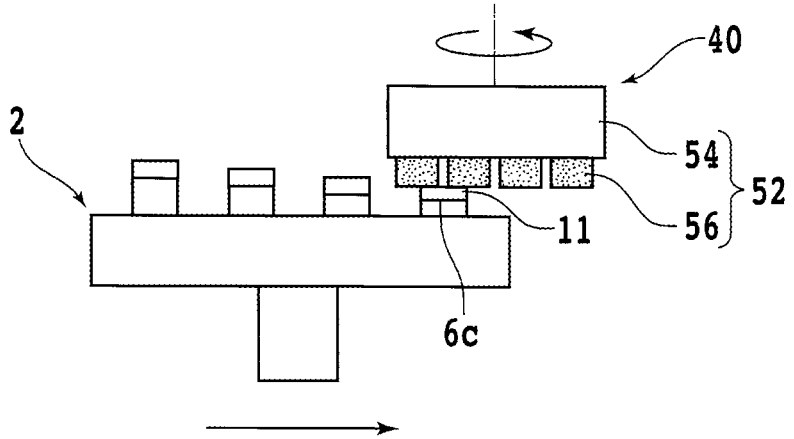
FIG. 4C is a side view schematically illustrating the state of the grinding step.

FIG. 3 is a flowchart schematically illustrating one example of a grinding method for workpieces in which the workpieces are ground by using the grinding apparatus 14. In this method, first, each of the multiple holding surfaces 6*c*, 8*c*, 10*c*, and 12*c* of the chuck table 2 is caused to hold a workpiece (holding step: S1). FIG. 4A is a side view schematically illustrating the state of the holding step (S1).

In this holding step (S1), first, the X-axis movement mechanism 18 is operated to position the chuck table 2 to a position at which workpieces 11 can be carried in to the multiple holding surfaces 6*c*, 8*c*, 10*c*, and 12*c* of the chuck table 2 (for example, a position separate from the grinding unit 40). Subsequently, the multiple workpieces 11 are each carried in to a respective one of the multiple holding surfaces 6*c*, 8*c*, 10*c*, and 12*c* of the chuck table 2.

For example, the workpieces 11 are package substrates with a rectangular parallelepiped shape, such as CSP substrates or QFN substrates, and the shape of the upper surface and the lower surface thereof is almost the same as the shape of the multiple holding surfaces 6*c*, 8*c*, 10*c*, and 12*c*. Subsequently, in a state in which the suction source that communicates with the suction path made inside the chuck table 2 through the valve and so forth is operated, this valve is opened. This completes the holding step (S1).

In the grinding method for workpieces illustrated in FIG. 3, after the holding step (S1), creep-feed grinding for the workpieces 11 each held by the respective one of the multiple holding surfaces 6*c*, 8*c*, 10*c*, and 12*c* is executed in states in which the grinding unit 40 is positioned at different heights (grinding step: S2).

Specifically, in the grinding step (S2), the workpieces 11 are ground by moving the chuck table 2 along the X-axis direction (first direction) and bringing the multiple grinding abrasive stones 56 that rotate into contact with the workpieces 11 each held by the respective one of the multiple holding surfaces 6*c*, 8*c*, 10*c*, and 12*c* while widening the interval between the reference surface 4*a* and the multiple grinding abrasive stones 56 along the Z-axis direction (second direction) in a stepwise manner to cause the workpieces 11 each held by the respective one of the multiple holding surfaces 6*c*, 8*c*, 10*c*, and 12*c* to have a predetermined finished thickness.

FIG. 4B, FIG. 4C, FIG. 5A, FIG. 5B, FIG. 5C, FIG. 6A, FIG. 6B, and FIG. 6C are side views schematically illustrating the state of the grinding step (S2). In this grinding step (S2), first, the Z-axis movement mechanism 28 lowers the grinding unit 40 to position the lower surfaces of the multiple grinding abrasive stones 56 of the grinding wheel 52 to a position higher than the holding surface 6*c* by the finished thickness of the workpiece 11 (see FIG. 4B).

Subsequently, while the chuck table 2 is moved rearward along the X-axis direction, multiple grinding abrasive stones 56 located on the front side of the grinding wheel 52 that rotates are brought into contact with the side of the upper surface of the workpiece 11 held by the holding surface 6*c*. As a result, the side of the upper surface of the workpiece 11 held by the holding surface 6*c* is ground from the rear end to the front end, and this workpiece 11 is thinned to the predetermined finished thickness (see FIG. 4C).

Figure 5A:
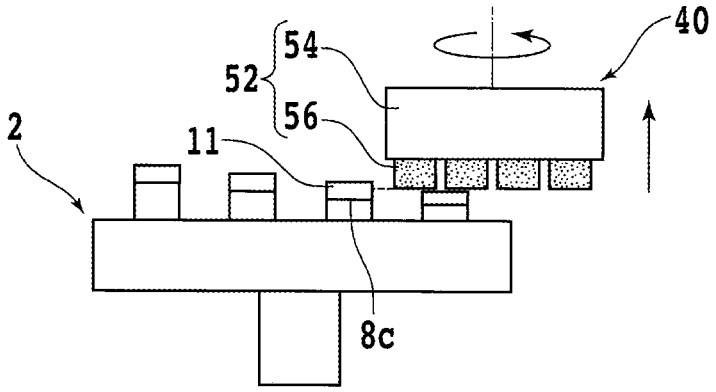
FIG. 5A is a side view schematically illustrating the state of the grinding step.
Figure 5B:
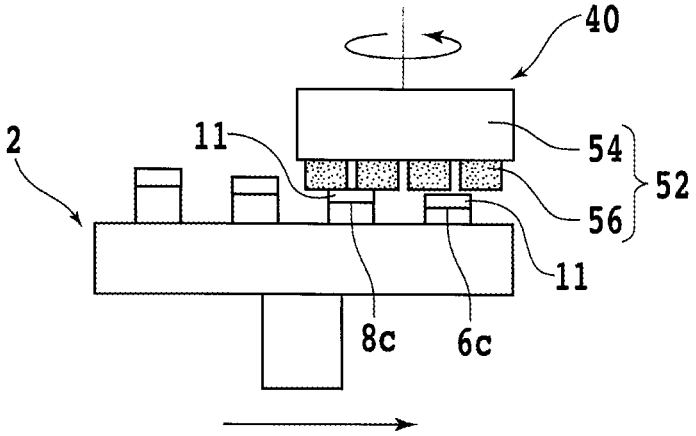
FIG. 5B is a side view schematically illustrating the state of the grinding step.

Next, the Z-axis movement mechanism 28 raises the grinding unit 40 to position the lower surfaces of the multiple grinding abrasive stones 56 of the grinding wheel 52 to a position higher than the holding surface 8*c* by the finished thickness of the workpiece 11 (see FIG. 5A).

Subsequently, while the chuck table 2 is moved rearward along the X-axis direction, the multiple grinding abrasive stones 56 located on the front side of the grinding wheel 52 that rotates are brought into contact with the side of the upper surface of the workpiece 11 held by the holding surface 8*c*. As a result, the side of the upper surface of the workpiece 11 held by the holding surface 8*c* is ground from the rear end to the front end, and this workpiece 11 is thinned to the predetermined finished thickness (see FIG. 5B).

At this time, multiple grinding abrasive stones 56 located on the rear side of the grinding wheel 52 that rotates are located over the workpiece 11 held by the holding surface 6*c* and do not come into contact with this workpiece 11. That is, the workpiece 11 held by the holding surface 6*c* is not ground again by the multiple grinding abrasive stones 56.

Figure 5C:
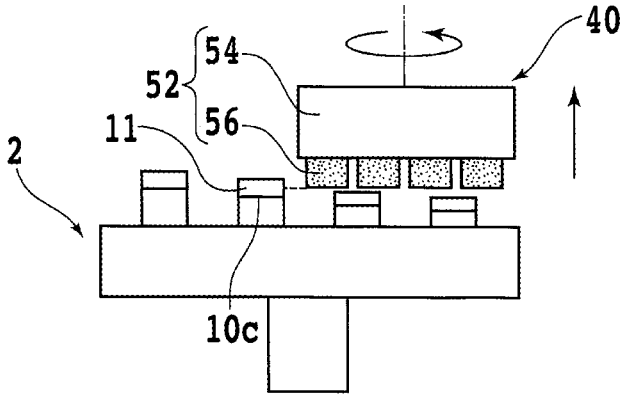
FIG. 5C is a side view schematically illustrating the state of the grinding step.

Next, the Z-axis movement mechanism 28 raises the grinding unit 40 to position the lower surfaces of the multiple grinding abrasive stones 56 of the grinding wheel 52 to a position higher than the holding surface 10*c* by the finished thickness of the workpiece 11 (see FIG. 5C).

Subsequently, while the chuck table 2 is moved rearward along the X-axis direction, the multiple grinding abrasive stones 56 located on the front side of the grinding wheel 52 that rotates are brought into contact with the side of the upper surface of the workpiece 11 held by the holding surface 10*c*. As a result, the side of the upper surface of the workpiece 11 held by the holding surface 10*c* is ground from the rear end to the front end, and this workpiece 11 is thinned to the predetermined finished thickness (see FIG. 6A).

At this time, the multiple grinding abrasive stones 56 located on the rear side of the grinding wheel 52 that rotates are located over the workpiece 11 held by the holding surface 8*c* and do not come into contact with this workpiece 11. That is, the workpiece 11 held by the holding surface 8*c* is not ground again by the multiple grinding abrasive stones 56.

Figure 6A:
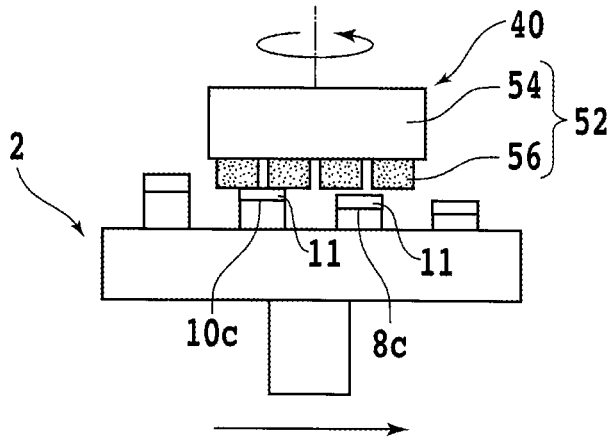
FIG. 6A is a side view schematically illustrating the state of the grinding step.
Figure 6B:
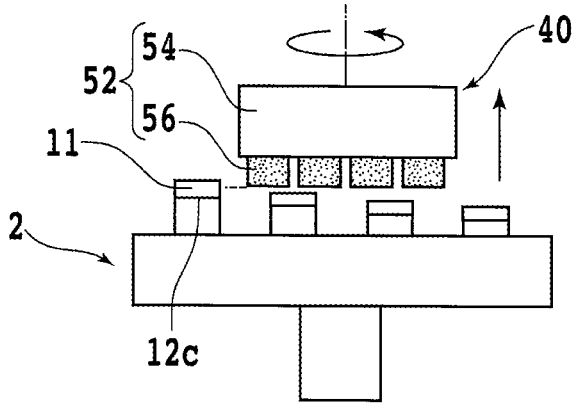
FIG. 6B is a side view schematically illustrating the state of the grinding step.
Figure 6C:
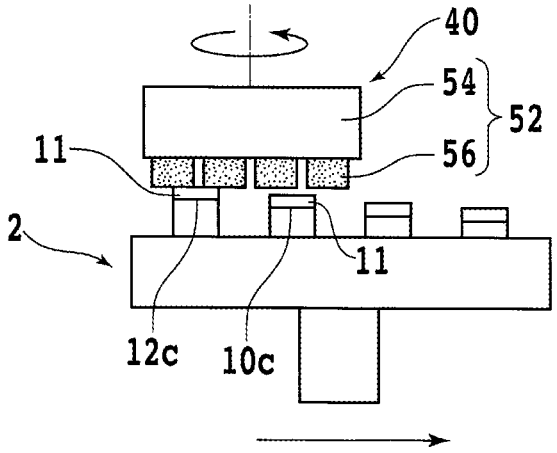
FIG. 6C is a side view schematically illustrating the state of the grinding step.

Next, the Z-axis movement mechanism 28 raises the grinding unit 40 to position the lower surfaces of the multiple grinding abrasive stones 56 of the grinding wheel 52 to a position higher than the holding surface 12*c* by the finished thickness of the workpiece 11 (see FIG. 6B).

Subsequently, while the chuck table 2 is moved rearward along the X-axis direction, the multiple grinding abrasive stones 56 located on the front side of the grinding wheel 52 that rotates are brought into contact with the side of the upper surface of the workpiece 11 held by the holding surface 12*c*. As a result, the side of the upper surface of the workpiece 11 held by the holding surface 12*c* is ground from the rear end to the front end, and this workpiece 11 is thinned to the predetermined finished thickness (see FIG. 6C).

At this time, the multiple grinding abrasive stones 56 located on the rear side of the grinding wheel 52 that rotates are located over the workpiece 11 held by the holding surface 10*c* and do not come into contact with the workpiece 11. That is, the workpiece 11 held by the holding surface 10*c* is not ground again by the multiple grinding abrasive stones 56. Through the above, the grinding step (S2) is completed.

In the chuck table 2, the multiple holding surfaces 6*c*, 8*c*, 10*c*, and 12*c* are disposed in such a manner that the heights from the reference surface 4*a* are in increasing order along the first direction parallel to each of them. Thus, in a case of using this chuck table 2, the creep-feed grinding for the workpieces 11 each held by the respective one of the multiple holding surfaces 6*c*, 8*c*, 10*c*, and 12*c* can be executed in states in which the grinding unit 40 is positioned at different heights.

In this case, the workpiece 11 for which the creep-feed grinding has been executed (for example, the workpiece 11 held by the holding surface 6*c*) is located on the lower side as viewed from the grinding unit 40 when another workpiece 11 (for example, the workpiece 11 held by the holding surface 8*c*) is ground. Due to this, in this creep-feed grinding, the specific workpiece 11 can be prevented from being ground twice.

Moreover, in the grinding method for workpieces according to the present invention, prior to the above-described holding step (S1), the chuck table 2 may be processed in the grinding apparatus 14 in such a manner that the heights of multiple holding surfaces of the chuck table 2 from the reference surface 4*a* are set to be in increasing order along the first direction. Due to this, for example, the above-described grinding step (S2) can be executed even in a case in which the heights of the upper surfaces of the holding parts 6, 8, and 10 from the reference surface 4*a* are equal to the height of the upper surface (holding surface) 12*c* of the holding part 12 from the reference surface 4*a*.

When the chuck table 2 is ground, in general, a grinding wheel (grinding wheel for the chuck table) that is different in kind from the grinding wheel used in grinding of the workpiece 11 (grinding wheel for the workpiece) is used. That is, in general, the chuck table 2 is ground by using the grinding wheel for the chuck table in which multiple grinding abrasive stones (grinding abrasive stones for the chuck table) that are different in kind from the multiple grinding abrasive stones included in the grinding wheel for the workpiece (grinding abrasive stones for the workpiece) are annularly disposed in a discrete manner.

Figure 7:
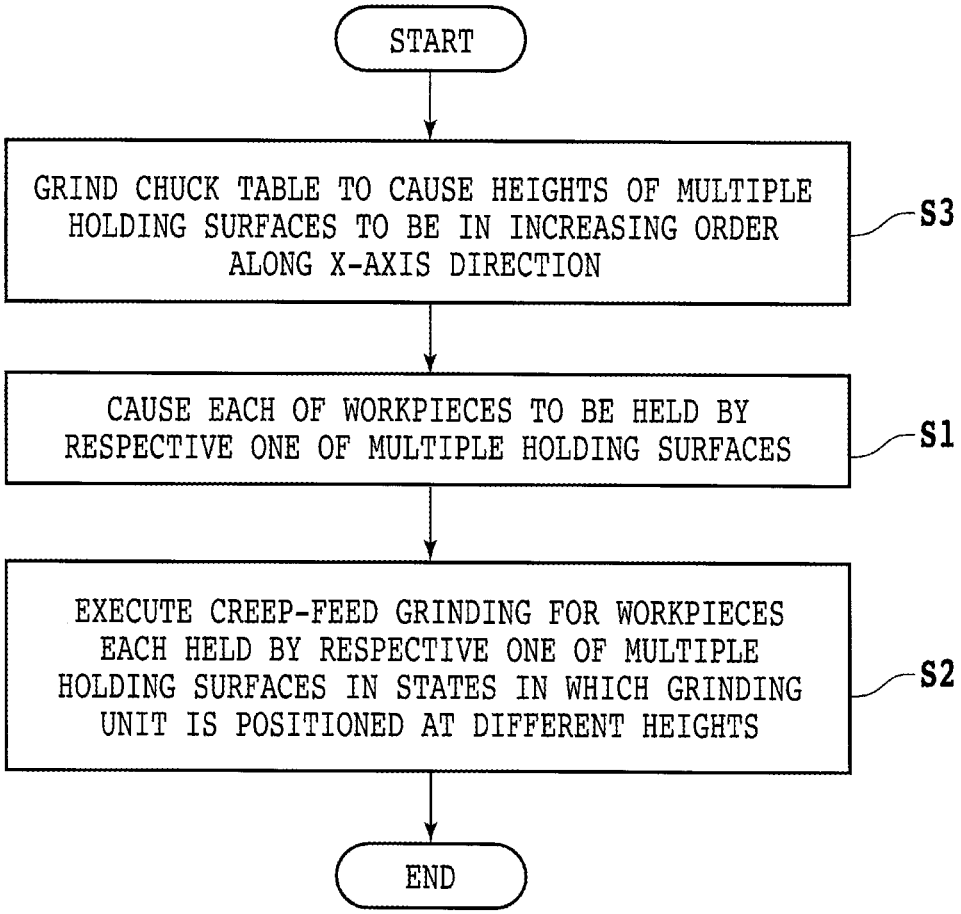
FIG. 7 is a flowchart schematically illustrating a modification example of the grinding method for workpieces.

FIG. 7 is a flowchart schematically illustrating one example of a grinding method for workpieces in which the chuck table 2 is processed prior to the holding step (S1). In this method, first, the chuck table 2 is ground to cause the heights of multiple holding surfaces of the chuck table 2 to be in increasing order along the X-axis direction (first direction) (holding surface grinding step: S3).

Specifically, in the holding surface grinding step (S3), the chuck table 2 is ground by moving the chuck table 2 along the X-axis direction (first direction) and bringing the multiple grinding abrasive stones for the chuck table that rotate into contact with the chuck table 2 while widening the interval between the reference surface 4*a* and the multiple grinding abrasive stones for the chuck table along the Z-axis direction (second direction) in a stepwise manner to cause the heights of the multiple holding surfaces from the reference surface 4*a* to be in increasing order along the X-axis direction.

FIG. 8A, FIG. 8B, FIG. 8C, FIG. 9A, FIG. 9B, and FIG. 9C are side views schematically illustrating the state of the holding surface grinding step (S3). In this holding surface grinding step (S3), first, the Z-axis movement mechanism 28 lowers the grinding unit 40 in such a manner that the lower surfaces of multiple grinding abrasive stones 56*a* for the chuck table annularly disposed in a discrete manner on the side of the lower surface of a wheel base 54*a* of a grinding wheel 52*a* for the chuck table are positioned to a position that is lower than the holding surface 12*c* but higher than the reference surface 4*a* (see FIG. 8A).

Subsequently, while the chuck table 2 is moved rearward along the X-axis direction, the multiple grinding abrasive stones 56*a* for the chuck table located on the front side of the rotating grinding wheel 52*a* for the chuck table are brought into contact with the side of the upper surface of the holding part 6. As a result, the side of the upper surface of the holding part 6 is ground from the rear end to the front end, and the upper surface of the holding part 6 makes a transition to a position lower than the holding surface 12*c*. That is, the holding surface 6*c* is formed (see FIG. 8B).

Figure 8A:
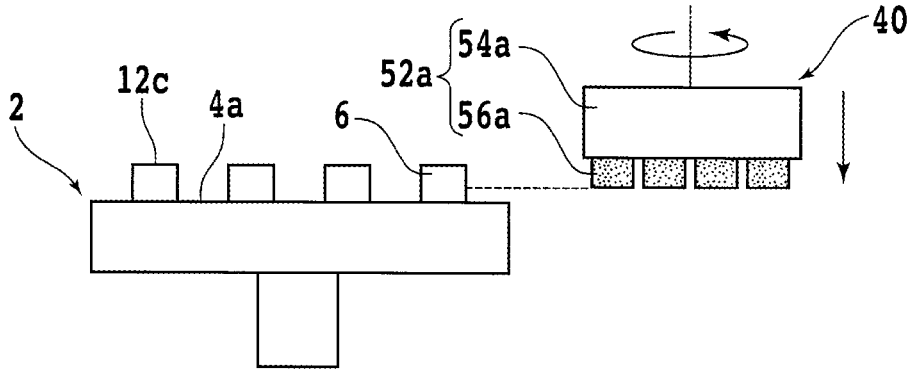
FIG. 8A is a side view schematically illustrating the state of a holding surface grinding step.
Figure 8B:
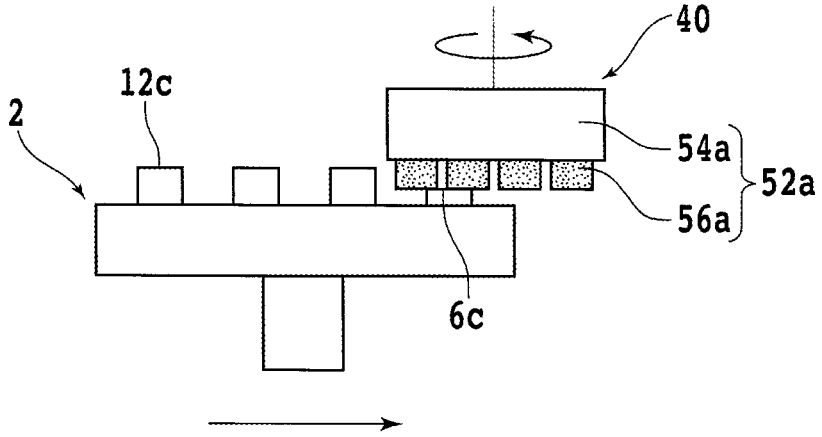
FIG. 8B is a side view schematically illustrating the state of the holding surface grinding step.
Figure 8C:
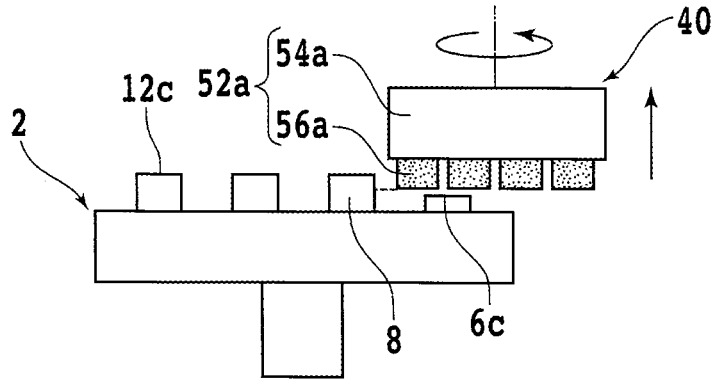
FIG. 8C is a side view schematically illustrating the state of the holding surface grinding step.

Next, the Z-axis movement mechanism 28 raises the grinding unit 40 to position the lower surfaces of the multiple grinding abrasive stones 56*a* for the chuck table to a position that is lower than the holding surface 12*c* but higher than the holding surface 6*c* (see FIG. 8C).

Subsequently, while the chuck table 2 is moved rearward along the X-axis direction, the multiple grinding abrasive stones 56*a* for the chuck table located on the front side of the rotating grinding wheel 52*a* for the chuck table are brought into contact with the side of the upper surface of the holding part 8. As a result, the side of the upper surface of the holding part 8 is ground from the rear end to the front end, and the upper surface of the holding part 8 makes a transition to a position that is lower than the holding surface 12*c* but higher than the holding surface 6*c*. That is, the holding surface 8*c* is formed (see FIG. 9A).

Figure 9A:
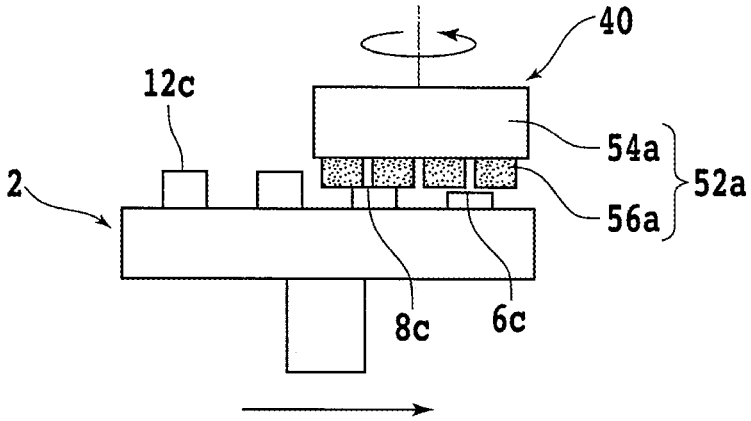
FIG. 9A is a side view schematically illustrating the state of the holding surface grinding step.
Figure 9B:
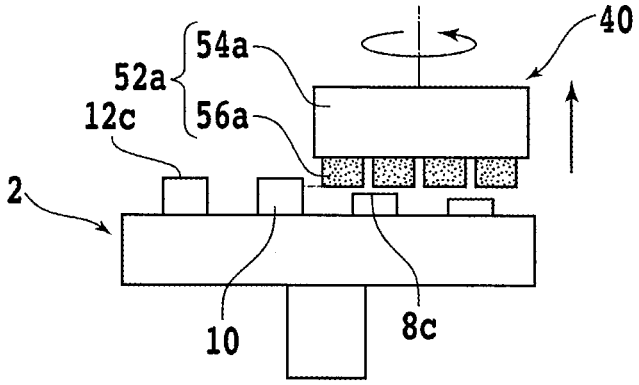
FIG. 9B is a side view schematically illustrating the state of the holding surface grinding step.
Figure 9C:
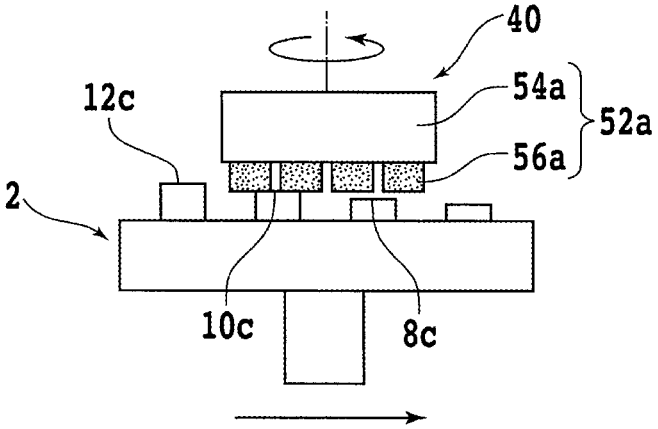
FIG. 9C is a side view schematically illustrating the state of the holding surface grinding step.

Next, the Z-axis movement mechanism 28 raises the grinding unit 40 to position the lower surfaces of the multiple grinding abrasive stones 56*a* for the chuck table to a position that is lower than the holding surface 12*c* but higher than the holding surface 8*c* (see FIG. 9B).

Subsequently, while the chuck table 2 is moved rearward along the X-axis direction, the multiple grinding abrasive stones 56*a* for the chuck table located on the front side of the rotating grinding wheel 52*a* for the chuck table are brought into contact with the side of the upper surface of the holding part 10. As a result, the side of the upper surface of the holding part 10 is ground from the rear end to the front end, and the upper surface of the holding part 10 makes a transition to a position that is lower than the holding surface 12*c* but higher than the holding surface 8*c*. That is, the holding surface 10*c* is formed (see FIG. 9C).

Through the above, the holding surface grinding step (S3) is completed. In the grinding method for workpieces illustrated in FIG. 7, after the holding surface grinding step (S3), the above-described holding step (S1) and grinding step (S2) are sequentially executed. As a result, in the grinding method for workpieces illustrated in FIG. 7, the specific workpiece 11 can be prevented from being ground twice as in the grinding method for workpieces illustrated in FIG. 3.

The above-described contents are one aspect of the present invention, and the contents of the present invention are not limited to the above-described contents. For example, in the chuck table of the present invention, the shape of each of the multiple holding surfaces is not limited to the rectangular shape and may be a polygonal shape in which three or five or more corners exist or a circular shape or an elliptical shape.

Further, in the chuck table of the present invention, the base part 4 may have a rectangular parallelepiped shape or an elliptical plate shape. Moreover, in the chuck table of the present invention, the heights from the reference surface 4*a* regarding some of the holding surfaces included in the multiple holding surfaces may be the same.

Specifically, in a case in which the diameter of the grinding wheel 52 is relatively long (for example, in a case in which the diameter of the grinding wheel 52 is at least 70% and at most 90% of the diameter of the chuck table 2), when the workpiece 11 held by the upper surface (holding surface) of the holding part 8 and/or the holding part 10 is ground by the multiple grinding abrasive stones 56 located on the front side of the grinding wheel 52, the multiple grinding abrasive stones 56 located on the rear side thereof have not reached the upper side of the holding part 6 in some cases.

In such a case, for example, the heights of the upper surfaces (holding surfaces) of the holding parts 6 and 8 from the reference surface 4*a* may be made the same. Alternatively, the heights of the upper surfaces (holding surfaces) of the holding parts 6, 8, and 10 from the reference surface 4*a* may be made the same. That is, in the chuck table of the present invention, the multiple holding surfaces may be classified into lower holding surfaces whose heights are equal to each other (for example, the upper surfaces of the holding parts 6 and 8 or the upper surfaces of the holding parts 6, 8, and 10) and holding surfaces higher than these lower holding surfaces (for example, the upper surfaces of the holding parts 10 and 12 or the upper surface of the holding part 12).

Further, in the grinding apparatus of the present invention, the X-axis movement mechanism 18 may be replaced by an X-axis movement mechanism that moves the grinding unit 40 along the X-axis direction. That is, in the grinding apparatus of the present invention, it suffices that the chuck table 2 and the grinding unit 40 can relatively move along the X-axis direction, and the constituent element for this purpose is not limited to any kind.

Similarly, in the grinding apparatus of the present invention, the Z-axis movement mechanism 28 may be replaced by a Z-axis movement mechanism that moves the chuck table 2 along the Z-axis direction. That is, in the grinding apparatus of the present invention, it suffices that the chuck table 2 and the grinding unit 40 can relatively move along the Z-axis direction, and the constituent element for this purpose is not limited to any kind.

Moreover, in the grinding method for workpieces according to the present invention, the grinding wheel for the chuck table and the grinding wheel for the workpiece may be the same grinding wheel. That is, in the grinding method for workpieces according to the present invention, the chuck table 2 and the workpieces 11 may be ground by using the same multiple grinding abrasive stones.

Besides, structures, methods, and so forth according to the above-described embodiment can be executed with appropriate changes without departing from the range of the object of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A chuck table comprising:

a first holding part with a first holding surface and a second holding part with a second holding surface that each have a same shape and are parallel to each other; and a reference surface that surrounds each of the first holding surface and the second holding surface in plan view and is parallel to the first holding surface and the second holding surface, wherein;

the chuck table holds each of workpieces by a respective one of the first holding surface and the second holding surface, the first holding surface and the second holding surface are disposed in such a manner that heights from the reference surface are in increasing order along a first direction parallel to each of the first holding surface and the second holding surface, the first holding part is formed such that the height of the first holding surface above the reference surface is fixed at a first height, the second holding part is formed such that the height of the second holding surface surface above the reference surface is fixed at a second height, and the second height is greater than the first height, wherein, when the second height is greater than the first height, a bottom surface of the first holding part and a bottom surface of the second holding part are on a common plane, wherein the common plane is parallel to the reference surface.

2. The chuck table of claim 1, wherein the first holding surface and the second holding surface each have a rectangular shape with a pair of short sides that extend along the first direction and a pair of long sides which have a length greater than a length of the short sides and that extend along a third direction perpendicular to the first direction and a second direction.

3. The chuck table of claim 1, wherein the first holding part is spaced apart from the second holding part along the first direction.

4. A grinding method for workpieces in which the workpieces are ground by using a grinding apparatus, the grinding apparatus including:

a chuck table including a first holding part with a first holding surface and a second holding part with a second holding surface that each have a same shape and are parallel to each other and a reference surface that surrounds each of the first holding surface and the second holding surface in plan view and is parallel to the first holding surface and the second holding surface, and being configured to hold each of the workpieces by a respective one of the first holding surface and the second holding surface, a grinding unit having a spindle with a tip part on which a grinding wheel in which multiple grinding abrasive stones are annularly disposed is mounted, a first movement mechanism that relatively moves the chuck table and with respect to the grinding unit along a first direction, and a second movement mechanism that relatively moves the grinding unit with respect to the chuck table along a second direction perpendicular to each of the reference surface, the first holding surface, and the second holding surface, the first holding surface and the second holding surface being disposed in such a manner that heights from the reference surface are in increasing order along the first direction parallel to each of the first holding surface and the second holding surface, wherein the first holding part is formed such that the height of the first holding surface above the reference surface is fixed at a first height, the second holding part is formed such that the height of the second holding surface above the reference surface is fixed at a second height, and the second height is greater than the first height, wherein, when the second height is greater than the first height, a bottom surface of the first holding part and a bottom surface of the second holding part are on a common plane, wherein the common plane is parallel to the reference surface, the grinding method comprising:

a holding step of causing each of the workpieces to be held by the respective one of the first holding surface and the second holding surface; and a grinding step of, after the holding step, grinding the workpieces by relatively moving the chuck table with respect to the grinding unit along the first direction and bringing the multiple grinding abrasive stones that rotate into contact with the workpieces each held by the respective one of the first holding surface and the second holding surface while relatively moving the multiple grinding abrasive stones with respect to the reference surface along the second direction in a stepwise manner to cause the workpieces each held by the respective one of the first holding surface and the second holding surface to have a predetermined finished thickness.

5. The grinding method of claim 4, wherein the first holding surface and the second holding surface each have a rectangular shape with a pair of short sides that extend along the first direction and a pair of long sides which have a length greater than a length of the short sides and that extend along a third direction perpendicular to the first direction and the second direction.

6. The grinding method of claim 4, wherein the first holding part is spaced apart from the second holding part along the first direction.

7. A grinding method for workpieces in which the workpieces are ground by using a grinding apparatus, the grinding apparatus including:

a chuck table including a first holding part with a first holding surface and a second holding part with a second holding surface that each have a same shape and are parallel to each other and a reference surface that surrounds each of the first holding surface and the second holding surface in plan view and is parallel to the first holding surface and the second holding surface, and being configured to hold each of the workpieces by a respective one of the first holding surface and the second holding surface, a grinding unit having a spindle with a tip part on which a grinding wheel for the chuck table in which multiple grinding abrasive stones for the chuck table are annularly disposed and a grinding wheel for the workpiece in which multiple grinding abrasive stones for the workpiece are annularly disposed is mounted, a first movement mechanism that relatively moves the chuck table with respect to the grinding unit along a first direction parallel to each of the reference surface, the first holding surface, and the second holding surface, and a second movement mechanism that relatively moves the grinding unit with respect to the chuck table along a second direction perpendicular to each of the reference surface, the first holding surface, and the second holding surface, the grinding method comprising:

a holding surface grinding step of grinding the first holding part and the second holding part of the chuck table by relatively moving the chuck table with respect to the grinding unit in which the grinding wheel for the chuck table is mounted on the tip part of the spindle along the first direction and bringing the multiple grinding abrasive stones for the chuck table that rotate into contact with the first holding part and the second holding part while relatively moving the multiple grinding abrasive stones for the chuck table along the second direction in a stepwise manner to form the first holding surface which is fixed at a first height and the second holding surface which is fixed at a second height such that the second height is greater than the first height and the heights of the first holding surface and the second holding surface from the reference surface increase along the first direction, wherein, when the second height is greater than the first height, a bottom surface of the first holding part and a bottom surface of the second holding part are on a common plane, wherein the common plane is parallel to the reference surface;

a holding step of causing each of the workpieces to be held by the respective one of the first holding surface and the second holding surface after the holding surface grinding step; and a grinding step of, after the holding step, grinding the workpieces by relatively moving the chuck table with respect to the grinding unit in which the grinding wheel for the workpiece is mounted on the tip part of the spindle, along the first direction, and bringing the multiple grinding abrasive stones for the workpiece that rotate into contact with the workpieces each held by the respective one of the first holding surface and the second holding surface while relatively moving the multiple grinding abrasive stones for the workpiece with respect to the reference surface along the second direction along the second direction in a stepwise manner to cause the workpieces each held by the respective one of the first holding surface and the second holding surface to have a predetermined finished thickness.

8. The grinding method of claim 7, wherein the first holding surface and the second holding surface each have a rectangular shape with a pair of short sides that extend along the first direction and a pair of long sides which have a length greater than a length of the short sides and that extend along a third direction perpendicular to the first direction and the second direction.

9. The grinding method of claim 7, wherein the first holding part is spaced apart from the second holding part along the first direction.

* * * * *